US006623307B2

(12) United States Patent
Korsunsky et al.

(10) Patent No.: US 6,623,307 B2
(45) Date of Patent: Sep. 23, 2003

(54) HIGH FREQUENCY MODULAR JACK CONNECTOR

(75) Inventors: Iosif R. Korsunsky, Harrisburg, PA (US); Kevin E. Walker, Hershey, PA (US); James H. Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 90 days.

(21) Appl. No.: 10/256,554

(22) Filed: Sep. 26, 2002

(65) Prior Publication Data

US 2003/0087556 A1 May 8, 2003

Related U.S. Application Data

(63) Continuation-in-part of application No. 10/037,061, filed on Nov. 8, 2001, now Pat. No. 6,506,080.

(51) Int. Cl.[7] ..... H01R 24/00

(52) U.S. Cl. ..... 439/676; 439/76; 439/83; 439/108; 439/608; 439/620; 439/941

(58) Field of Search ..... 439/620, 676, 439/941, 76, 83, 608, 610, 108, 609

(56) References Cited

U.S. PATENT DOCUMENTS 5,456,616 A * 10/1995 Fuerst et al. ..... 439/620
5,460,533 A * 10/1995 Broeksteeg et al. ..... 439/108
6,010,367 A * 1/2000 Wu ..... 439/620
6,206,730 B1 * 3/2001 Avery et al. ..... 439/609
6,227,911 B1 * 5/2001 Boutros et al. ..... 439/620
6,302,741 B1 * 10/2001 Fasold et al. ..... 439/620
6,319,064 B1 * 11/2001 Belopolsky et al. ..... 439/620

* cited by examiner

*Primary Examiner*—Tho D. Ta
*Assistant Examiner*—Truc Nguyen
(74) *Attorney, Agent, or Firm*—Wei Te Chung

(57) ABSTRACT

A modular jack connector (1) adapted for mounting onto a mother board includes a housing (10), a contact insert (20) received in the housing, LEDs (70, 90) and a metal shield (80). The contact insert includes two insert subassemblies (30, 40), and a noise suppressing device (60) assembled to the two insert subassemblies. Each insert subassembly has a circuit board (31, 41) and a set of contacts (32, 42) electrically connecting to the circuit board. The noise suppressing device includes two magnetic modules (33, 43) and a third circuit board (51). The magnetic modules each include upward pins (331, 431), downward pins (332, 432), and magnetic coils conductively interconnecting the upward and downward pins. The upward pins are selected to electrically connect to either the two circuit boards or the third circuit board, and the downward pins are adapted for being mounted onto the mother board.

1 Claim, 7 Drawing Sheets

HIGH FREQUENCY MODULAR JACK CONNECTOR

CROSS-REFERENCE TO RELATED APPLICATIONS

This patent application is a continuation-in-part (CIP) of U.S. patent application Ser. No. 10/037,061, filed on Nov. 8, 2001, now U.S. Pat. No. 6,506,080 entitled "RJ MODULAR CONNECTOR HAVING SUBSTRATE HAVING CONDUCTIVE TRACE TO BALANCE ELECTRICAL COUPLINGS BETWEEN TERMINALS" and is related to U.S. Patent Application with an unknown serial number, entitled "STACKED MODULAR JACK ASSEMBLY HAVING BUILT-IN CIRCUIT BOARDS".

BACKGROUND OF THE INVENTION

1. Field of the Invention

The present invention generally relates to a modular electrical connector, and more particularly to a stacked modular jack connector for use in the transmission of high frequency signals.

2. Description of Prior Arts

Data communication networks are being developed which enable the flow of information to ever greater numbers of users at ever higher transmission rates. However, data transmitted at high rates in multi-pair data communication cables has an increased susceptibility to crosstalk, which often adversely affects the processing and integrity of the transmitted data. The higher the frequency of signal is, the more serious the crosstalk issue is.

In the case of local area network (LAN) systems employing electrically distinct twisted wire pairs, crosstalk occurs when signal energy inadvertently "crosses" from one signal pair to another. The point at which the signal crosses or couples from one set of wires to another may be within the connector or internal circuitry of the transmitting station, referred to as "near-end" crosstalk.

Near-end crosstalk is especially troublesome when high frequency modular electrical connectors are in use in LAN system. Such modular electrical connectors include modular plugs and modular jacks. Specifically, a two-port modular jack which is employed in a stack LAN connector assembly, generally includes an upper port and a lower port, each port having a plurality of conductors received therein. Conductors from the upper port have to be always arranged or placed outside of conductors from the lower port underneath the upper one, i.e. the upper conductors are usually longer than the lower ones which may rise the problem of electrical resistance and impedance matching in high performance circuit. And the layout of mother board, onto which the modular jack is mounted, is restricted and parts for the lower port should be always finished first during the assembling process. Such configurations of a stacked modular jack assembly are presented in several patents as introduced hereinafter.

U.S. Pat. No. 5,531,612 issued to Goodall et al on Jul. 2, 1996 and its corresponding European Patent Application No. 94308734.6, disclosed a modular jack assembly for mounting to a printed circuit board. The modular jack comprises a plurality of modular jacks assembled to a common integral housing and arranged in two rows. It is easy to see that the contacts of an upper modular jack are longer than that of a lower modular jack in a same column. Similarly, U.S. Pat. No. 5,639,267 issued to Maxconn Incorporated on Jun. 17, 1997 and U.S. Pat. No. 6,267,628 issued to Stewart Connector Systems, Inc. on Jul. 31, 2001, respectively illustrate a modular jack assembly which comprises an upper contact pin longer than a lower contact pin.

Hence, an improved stacked modular jack connector is desired to overcome the disadvantages of the prior art.

BRIEF SUMMARY OF THE INVENTION

Accordingly, an object of the present invention is to provide a stacked modular jack connector for use in data transmission at high frequencies.

Another object of the present invention is to provide a stacked modular jack connector which reduces near-end crosstalk during data transmission.

In order to achieve the above-mentioned objects, a modular jack connector adapted for mounting onto a mother board includes an integral housing, a contact insert received in housing, an upper LED insert and a lower LED insert assembled in the housing and a metal shield. The contact insert comprises an upper insert subassembly, a lower insert subassembly, and a noise suppressing device. Each insert subassembly has a circuit board having conductive traces arranged thereon and a set of contacts electrically connected to the circuit board. The noise suppressing device comprises two magnetic modules and a third circuit board. Each magnetic module electrically connects to a corresponding set of contacts via the conductive traces which performs to affect the cross-talk occurred between the contacts. The magnetic modules each comprise upward pins disposed on a top face, downward pins disposed on a bottom face for electrically connecting to the mother board, and coils conductively interconnecting the upward and downward pins. Some of the upward pins of the two modules all penetrate through rear portions of the two circuit boards, and can be selectively soldered onto one of them to electrically connect to the contacts soldered on the same circuit board. The rest of the upward pins electrically contact to the third circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
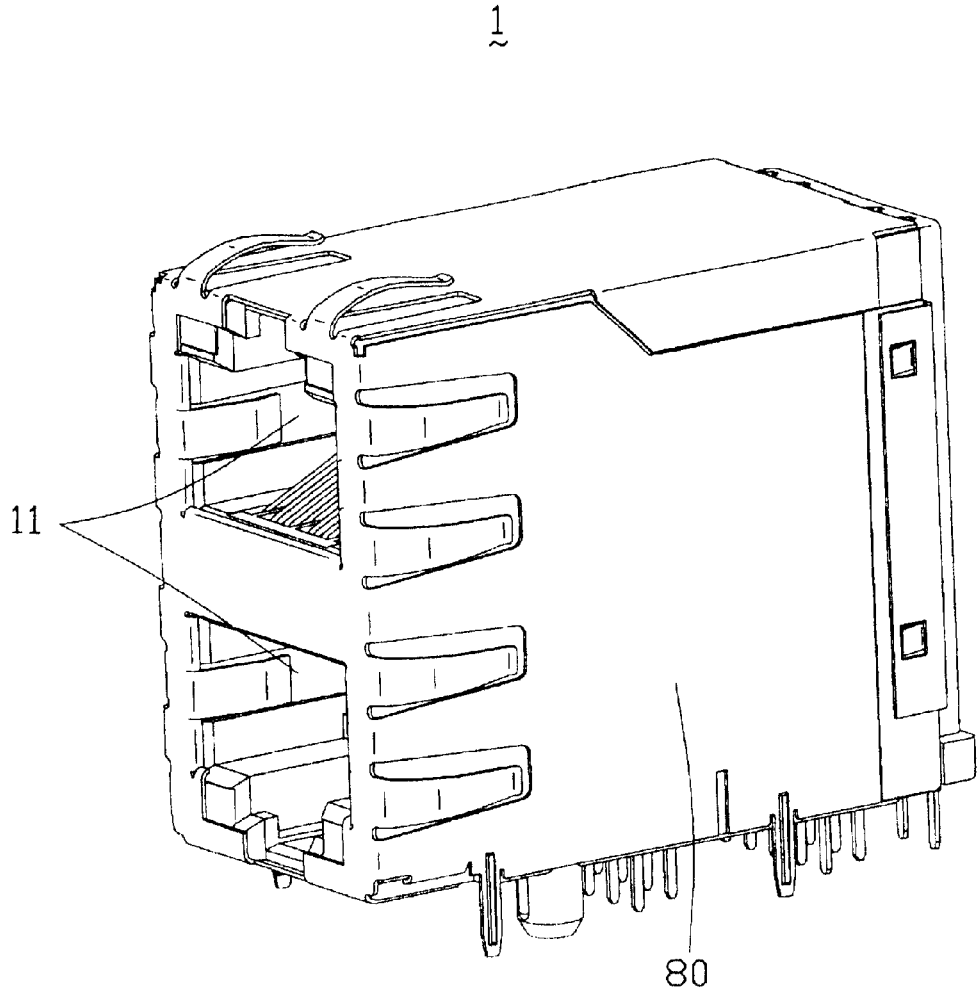
FIG. 1 is a perspective view of a modular jack connector in accordance with the present invention.

Reference will now be made to the drawing figures to describe the present invention in detail.

Figure 2:
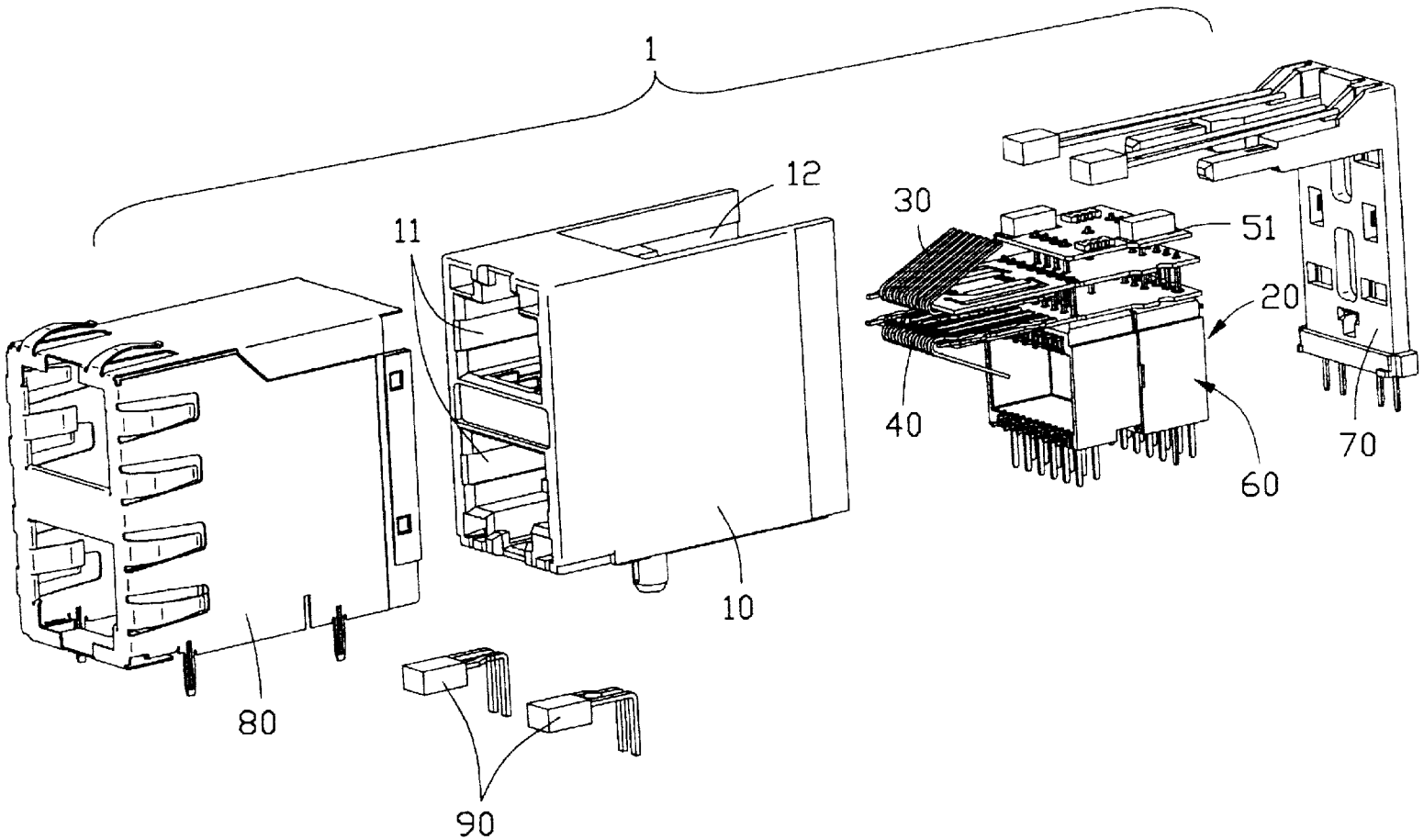
FIG. 2 is an exploded view of FIG. 1.

With reference to FIGS. 1 and 2, an exemplary, high frequency modular jack connector 1 is structured in accordance with the present invention, which is adapted for mounting on a mother board (not shown). The modular jack connector 1 comprises an integral housing 10, a contact insert 20 received in the integral housing 10, an upper LED insert 70 and two lower LED inserts 90 attached in the housing 10, and a metal shield 80 embracing the housing 10.

The integral housing 10 defines a pair of plug receiving holes 11 in a front side for receiving complementary modular plugs (not shown) therein and a contact insert opening 12 in a rear side which is in communication with the pair of plug receiving holes 11. The contact insert opening 12 is configured to receive therein the contact insert 20.

Figure 3:
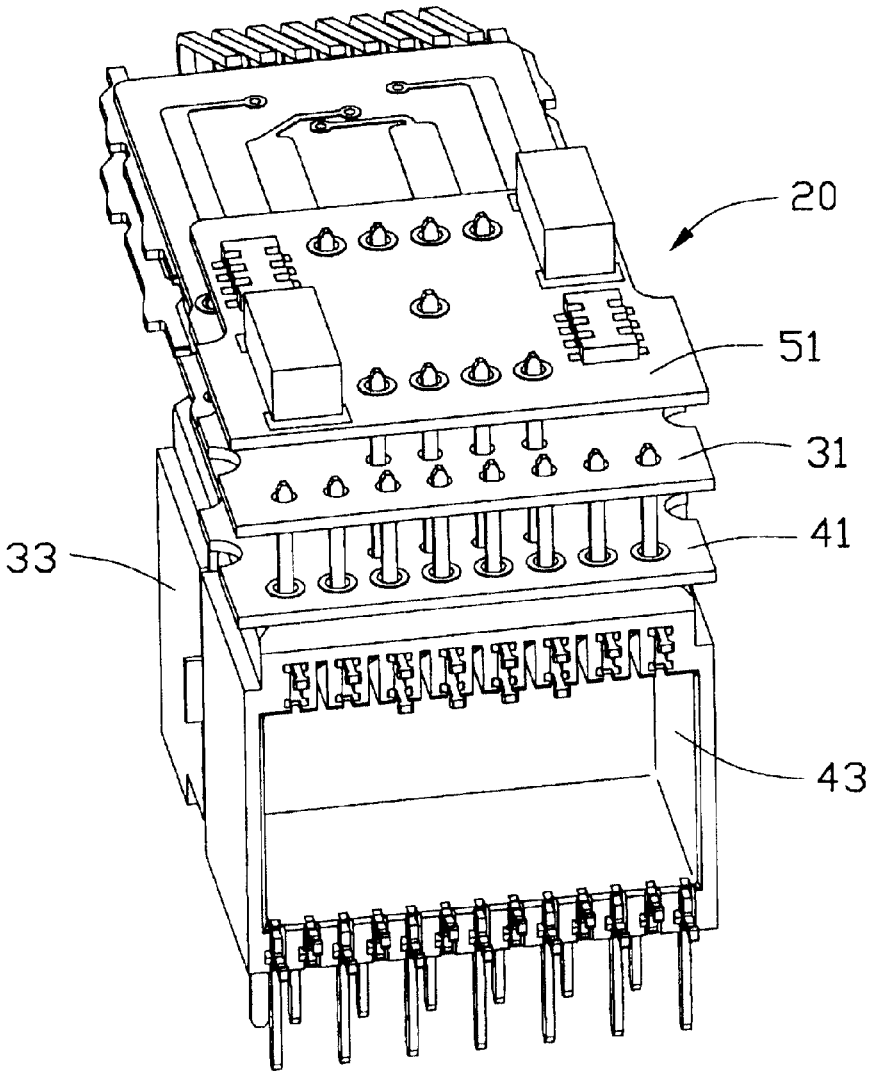
FIG. 3 is a perspective view of a contact insert of the modular jack connector of FIG. 1.
Figure 4:
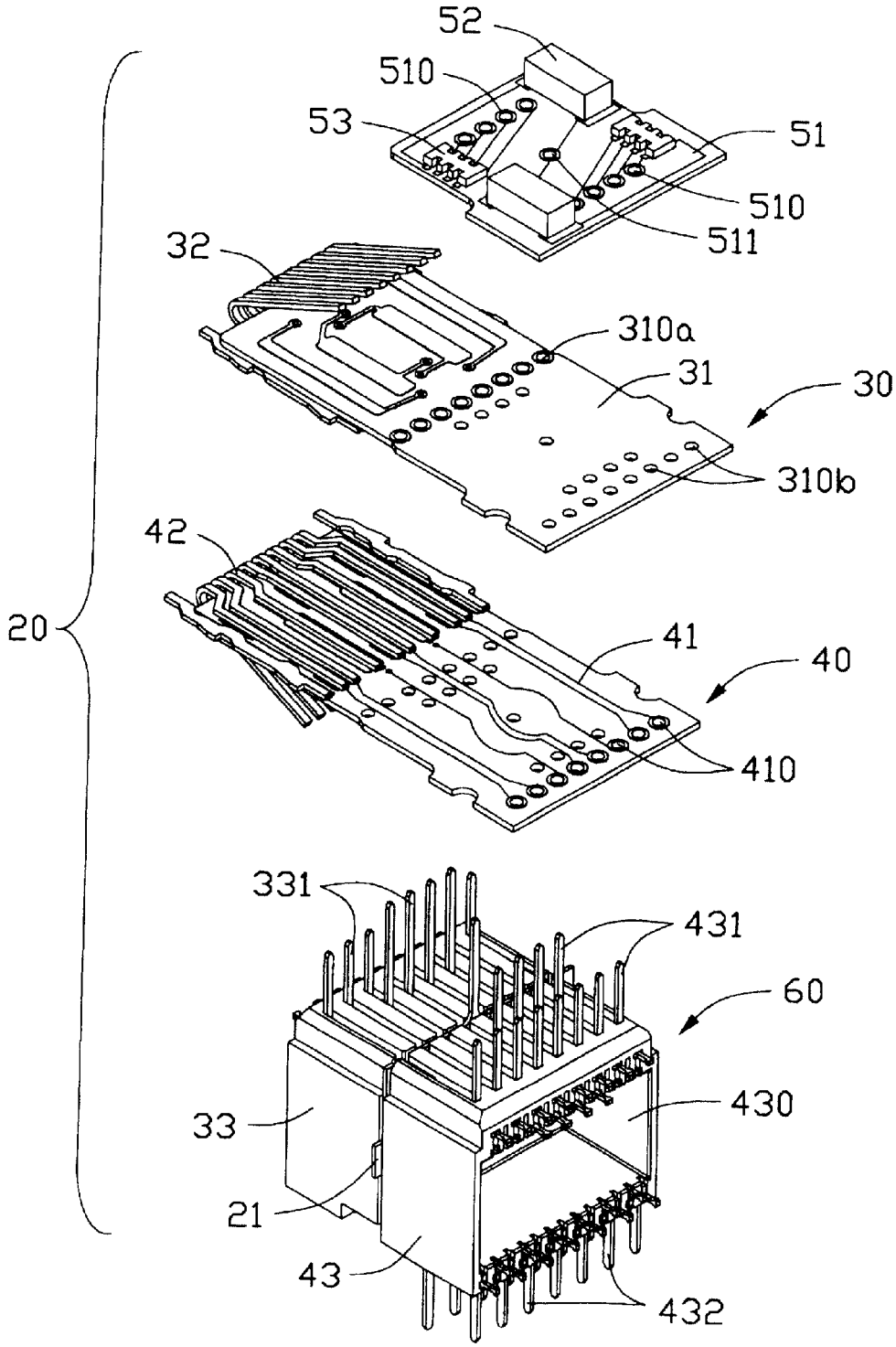
FIG. 4 is an exploded, perspective view of the contact insert of FIG. 3.
Figure 5:
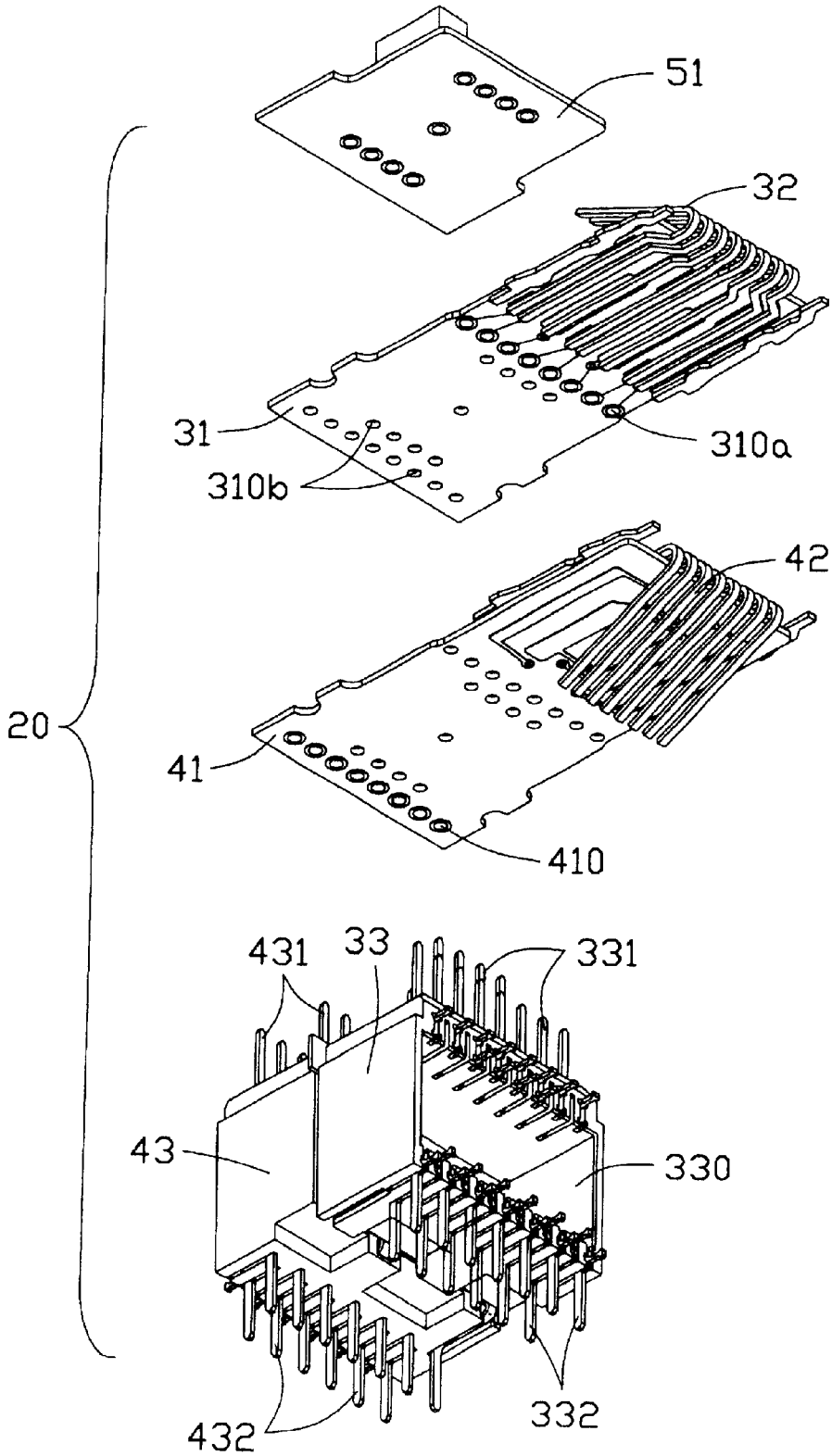
FIG. 5 is another exploded, perspective view of the contact insert of FIG. 3.

As shown in FIGS. 3, 4 and 5, the contact insert 20 includes an upper insert subassembly 30, a lower insert subassembly 40, and a noise suppressing device 60. Specifically, the two insert subassemblies 30, 40 each comprise a circuit board 31, 41, a set of identical contacts 32, 42 mounted onto conductive traces on the circuit board 31, 41. The contacts 32, 42 for either upper or lower insert subassembly are geometrically identical while opposite to each other and soldered onto the corresponding circuit board 31, 41 which has specially designed conductive traces to affect the noise between contact pairs. The two circuit board 31, 41 are spaced from each other and positioned in a stacked manner. Details of the configurations of the contacts 32, 42 and the particularly arranged conductive traces of the circuit boards 31, 41 can refer to the mother patent application Ser. No. 10/037,061, from which a priority right of this patent application is claimed.

The noise suppressing device 60 includes front and rear magnetic modules 33, 43 located back-to-back, a metal plate 21 sandwiched between the magnetic modules 33, 43, and a third circuit board 51. Each magnetic module 33, 43 defines a coil receiving opening 330, 430 for receiving a number of coils (not shown) therein. A plurality of upward pins 331, 431 are disposed on a top surface of each magnetic module 33, 43 and a plurality of downward pins 332, 432 are disposed on a bottom surface of the magnetic modules 33, 43. The upward pins 331, 431 electrically connect with the downward pins 332, 432 via wires of the corresponding coils.

The upward pins 331 of the front magnetic module 33 project upwards and penetrate through a rear portion of the lower circuit board 41 and extend toward the upper circuit board 31. Tail portions of some of the upward pins 331 are soldered into plated through-holes 310*a* of the upper circuit board 31, and tail portions of the other upward pins 331 protrude upwards through the upper circuit board 31 and are soldered into plated through-holes 510 of the third circuit board 51. The third circuit board 51 contains thereon a number of capacitors 52 and resisters 53 that are electrically connected with the tail portions of the other upward pins 331 for purpose of suppressing noises. The downward pins 332 of the front magnetic module 33 of the upper insert subassembly 30 are soldered to the mother board.

Similarly, the upward pins 431 of the rear magnetic module 43 project upwards and extend beyond the rear portion of the lower circuit board 41. Some tail portions of the upward pins 431 are soldered into plated through-holes 410 of the lower circuit board 41 and mechanically received in the through-holes 310*b* of the upper circuit board 31. The rest tail portions of the upward pins 431 protrude upwards and orderly penetrate through the lower and upper circuit boards 41, 31. The rest tail portions of the upward pins 431 are finally soldered into the corresponding plated through-holes 510 of the third circuit board 51 and electrically connect to the capacitors 52 and the resisters 53 for purpose of suppressing noises. The downward pins 432 of the rear magnetic module 43 are soldered to the mother board.

Advantageously, the upward pins 331, 431 of the two magnetic module 33, 43 all penetrate through the rear portions of the corresponding two circuit boards 41, 31 and are selectively soldered onto one of them to electrically connect to the contacts 32, 42 soldered on the same circuit board.

Figure 6:
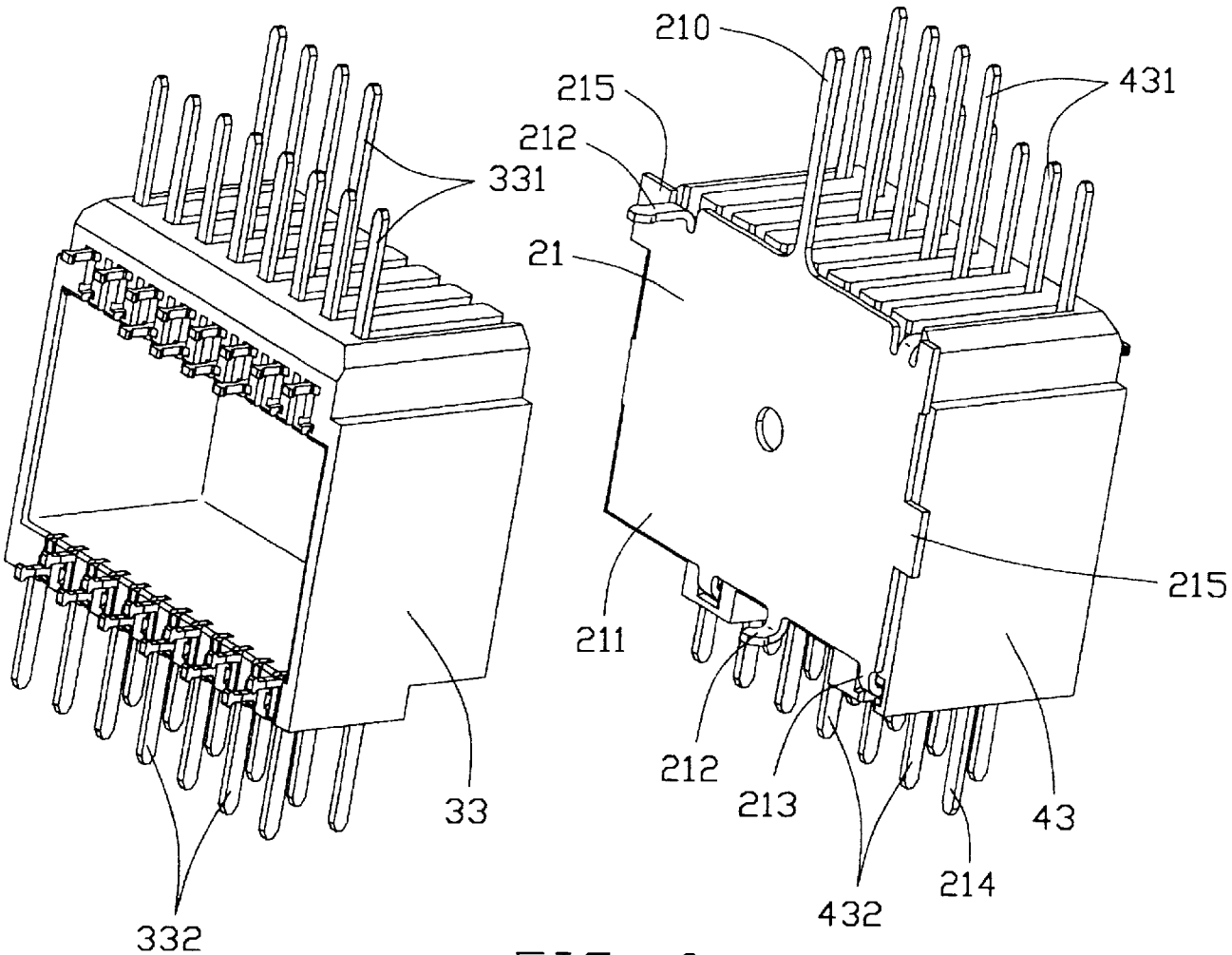
FIG. 6 is a partially exploded, perspective view of a pair of magnetic modules and a metal plate.
Figure 7:
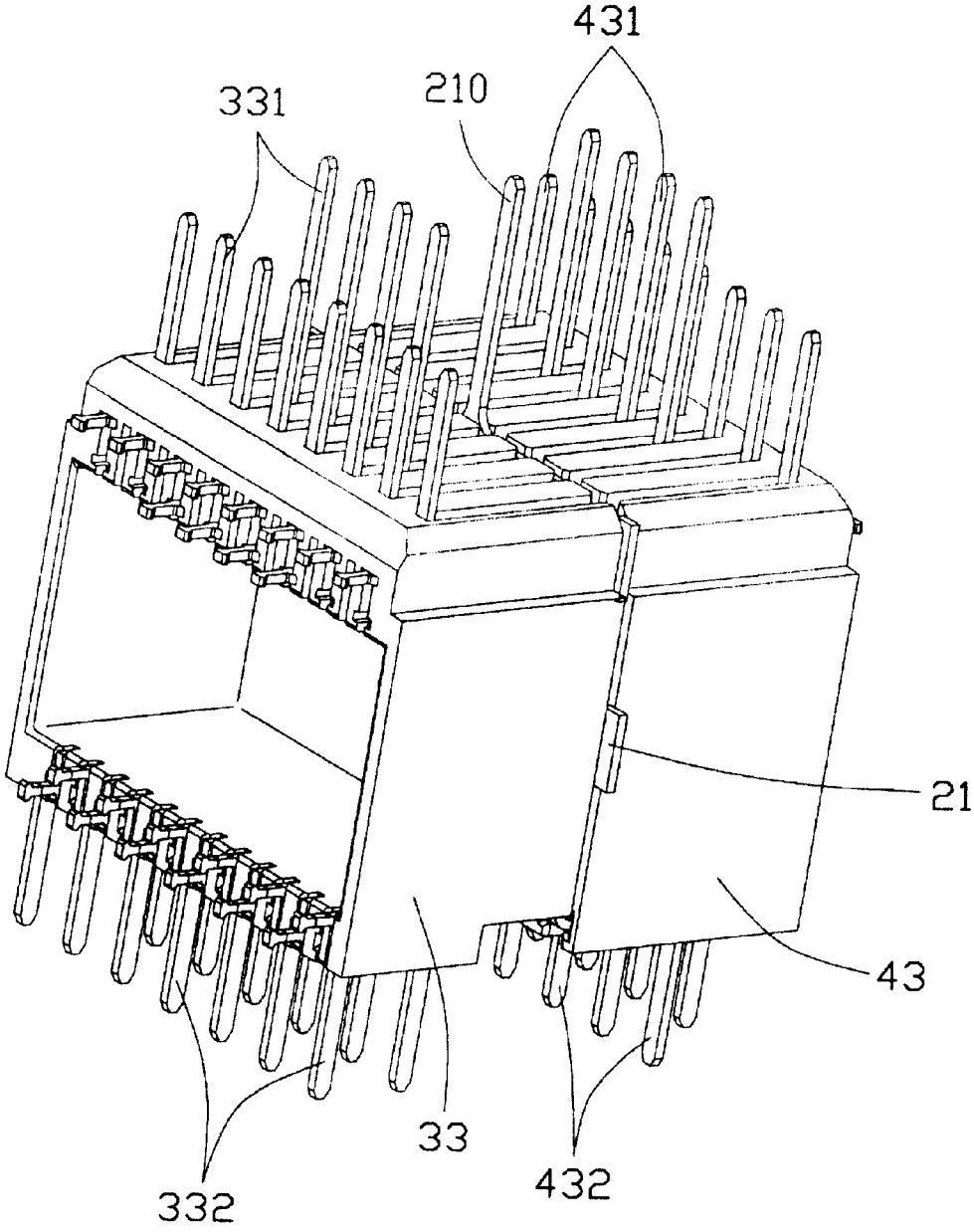
FIG. 7 is an assembled, perspective view of FIG. 7.

Furthermore, referring to FIGS. 6 and 7, the metal plate 21 has a rectangular main body 211 sandwiched between the front and rear magnetic modules 33, 43, and a number of fingers 212 extending oppositely from top and bottom edges of the main body 211 which are retained in slots of the front and rear magnetic modules 33, 43 for interconnecting the two magnetic modules 33, 43 together. An upper grounding pin 210 extends upwards from the top edge of the main body 211 for being soldered into a plated through-hole 511 which is defined in a center of the third circuit board 51 for grounding purpose. A lower grounding pin 213 projects from the bottom edge of the main body 211 and is bent to have a distal end 214 thereof extending downwards along a same direction of the extension of the downward pins 332, 432 for being soldered to the mother board. The metal plate 21 further has a pair of tabs 215 protruding from opposite lateral edges thereof. The metal plate 21 is so configured as to electrically shield the front and rear magnetic modules 33, 43 for reducing crosstalk thereof.

In assembly, firstly, the lower LED insert 90 is retained in the housing 10. A rear section of the contact insert 20 is then received in the contact insert opening 12 of the housing 10 while respectively exposing the two set of contacts 32, 42 in the two plug receiving holes 11 for electrically connecting to the complementary modular plugs. Subsequently, the upper LED insert 70 is inserted into and retained within the inside of the housing 10. Finally, the metal shield 80 is attached onto and covers the housing 10 for the known purpose of shielding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector engagable with a complementary connector for transmitting high frequency signals, comprising:

an insulative housing;

first and second contact subassemblies being received in said insulative housing and each having a plurality of contacts;

at least one magnetic module having upper pins and lower pins conductively connecting with said upper pins, some of said upper pins being selected to electrically connect with said contacts of said first and second contact subassemblies, respectively, rest ones of said upper pins being mechanically attached onto said first and second contact subassemblies; and wherein said upper pins of each magnetic module are disposed on a top face of said magnetic module and said lower pins are disposed on a bottom face of said magnetic module; and a metal plate attached to said at least one of magnetic module for grounding purpose, said metal plate having at least one finger fixed into said at least one magnetic module; and a filter means having capacitors and resistors electrically connecting with said at least on magnetic module; and a metal shield substantially enclosing said housing; and wherein said first and second contact subassemblies each have a printed circuit board with said contacts conductively thereto; and wherein said two printed circuit boards are stackedly arranged and spaced from each other a predetermined distance; and wherein said at least one magnetic module is positioned below rear portions of said two printed circuit boards; and wherein said metal plate provide an upper grounding pin adapted for conductively connecting to said filter means and a lower grounding pin adapted for conductively connecting to a mother board on which said electrical connector is mounted; and wherein said housing defines a pair of receiving holes, and said contacts of said first and second contact subassemblies are respectively received in said receiving holes for electrically connecting to the complementary connector.

* * * * *